United States Patent [19]

Sowers

[11] Patent Number: 4,770,070

[45] Date of Patent: Sep. 13, 1988

[54] RATCHET TOOL HAVING OPEN-ENDED JAWS

[76] Inventor: David A. Sowers, 4411 NW. 105 Ter., Coral Springs, Fla. 33065

[21] Appl. No.: 75,560

[22] Filed: Jul. 20, 1987

[51] Int. Cl.[4] ..... B25B 13/52

[52] U.S. Cl. ..... 81/61; 81/418; 81/90.5

[58] Field of Search ..... 81/3.43, 57.17, 60, 81/61, 64, 65.2, 68, 70, 314, 433, 434, 418, 90.3, 90.4, 90.5

[56] References Cited

U.S. PATENT DOCUMENTS

| | | | |
|---|---|---|---|
| 750,440 | 1/1904 | Downing | 81/65.2 |
| 768,146 | 8/1904 | Reams | 81/68 |
| 1,675,748 | 7/1928 | Bunker | 81/65.2 |
| 1,760,167 | 5/1930 | Palmer | 81/65.2 |
| 2,353,642 | 7/1944 | Buice | 81/65.2 |
| 2,862,690 | 12/1958 | Mason | 81/57.17 |

*Primary Examiner*—Frederick R. Schmidt
*Assistant Examiner*—Blynn Shideler
*Attorney, Agent, or Firm*—John H. Faro

[57] ABSTRACT

A tool having a pair of open-ended jaws with spaced confronting jaw faces and a support for the jaws, wherein each jaw comprises a continuous loop of chained links movably mounted on a plurality of rotatable rollers, said rollers being floatingly mounted on said support, each of said loops having a substantially straight segment that is spaced from and confronts the straight segment of the other of said loops, each link having a tread on the outer side of said loop, which tread aligns with the treads of the other links in said straight segments to constitute the confronting face of said jaw, and a ratchet means mounted on said support and adapted to push one of said loops to move in only one direction around its supporting rollers.

10 Claims, 4 Drawing Sheets

RATCHET TOOL HAVING OPEN-ENDED JAWS

BACKGROUND OF THE INVENTION

1. Field of the Invention

This invention relates to a novel ratchet tool having open-ended jaws, and particularly to such a tool wherein the jaw faces can be ratcheted to permit the tool to be rotated in only one direction around a nut or bolt head. The tool may be provided in several forms including: an open-ended wrench, a scissor-type pliers, a slip-type pliers, a vise-grip pliers, and a crescent wrench.

2. Description of the Prior Art

Open-ended wrenches and pliers are available in several forms as mentioned above. An open-ended wrench, as opposed to a socket wrench or box wrench (which are close-ended), has a pair of spaced confronting jaws that are open at one end so that the jaw faces of the wrench can be slid onto the faces of a nut or bolt head in a direction that is perpendicular to the longitudinal axis of the nut or bolt. As with close-ended wrenches, an open-ended wrench is also open on two other sides so that the jaw faces can be slid onto the faces of a nut or bolt head in a direction that is parallel to the longitudinal axis of the nut or bolt.

While many practical close-ended wrenches are available with ratchet means cooperating with the jaws of the tool, there are no practical open-ended wrenches with ratchet means cooperating with the jaw faces of the tool. Such a cooperating combination would permit the user to slide the jaw faces onto the faces of a nut or bolt head from its end, and then to rotate the nut or bolt head by a succession reciprocating arcuate movements of the tool without the tool being removed from contact with the nut or bolt.

OBJECTS OF THE INVENTION

An object of this invention is to provide a novel tool having a pair of open-ended jaws.

Another object is to provide a tool having a pair of open-ended jaws which are ratcheted.

A further object is to provide a novel tool having a pair of open-ended jaws which can tighten or loosen a nut or bolt head with a succession of arcuate movements without disengaging from the nut or bolt head.

Still another object is to provide a novel tool having a pair of open-ended jaws wherein each jaw face comprises a segment of a loop of chained links.

SUMMARY OF THE INVENTION

The novel tool comprises a pair of open-ended jaws with spaced confronting jaw faces and a support for said jaws. Unlike prior tools of this type, each jaw of the novel tool comprises a continuous loop of chained links movably mounted on a plurality of rotatable rollers, which rollers are floatingly mounted on the support. Each of the loops has a substantially straight segment that is spaced from and confronts the other segment. Each link has a tread on its outer side, which tread aligns with the treads of the other links in the straight segments to constitute the confronting faces of the jaws. There is a ratchet means mounted on the support, such as a spring-loaded dog, detachably engaging one or each loop, adapted to push the loop or loops to move in only one direction around its supporting rollers.

With the foregoing structural combination, the jaw faces of the novel tool can be slid onto opposed faces of a nut or bolt as with prior tools with open-ended jaw faces. However, with the novel tool, the bolt or nut may be tightened or loosened with a succession of reciprocating arcuate movements of the tool without disengaging the tool from the nut or bolt as is required with prior open-ended tools. This feature provides for enhanced convenience and considerable savings in labor and time by the user.

DETAILED DESCRIPTION OF THE INVENTION INCLUDING THE PREFERRED EMBODIMENTS

Figure 1:
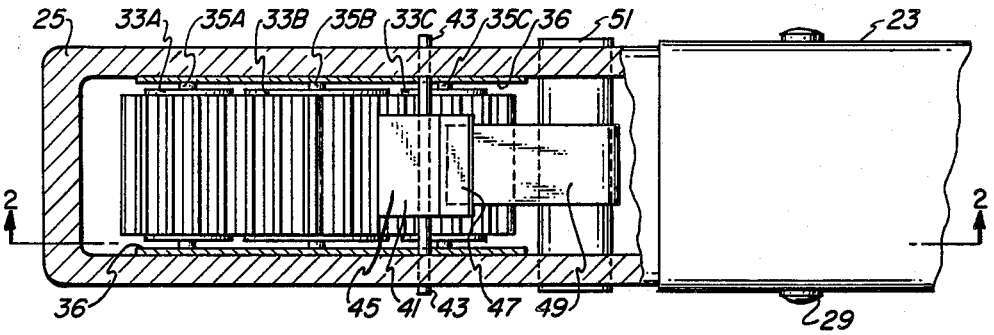
FIGS. 1 and 2 are broken-away top and side views of a preferred embodiment of the novel tool in the form of a vise-grip pliers, shown just after a nut has been rotated by arcuate movement of the tool.

The following description of some of the preferred embodiments of the concepts of this invention is made in reference to the accompanying figures. Where an individual structural element is depicted in more than one figure, it is assigned a common reference numeral for simplification of identification and understanding.

Figure 2:
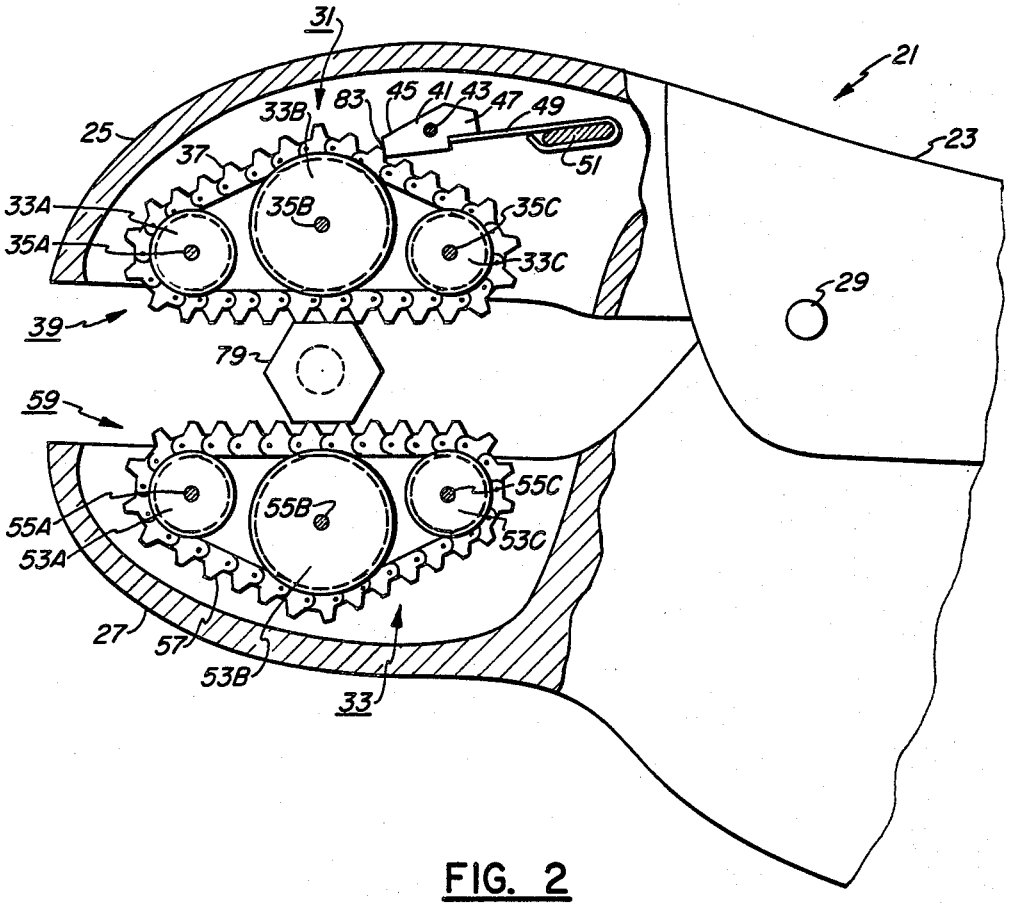

FIGS. 1 and 2 show top and side views of the novel device in the form of a vise-grip pliers. In FIG. 1, the upper part of the upper housing members is broken away. In FIG. 2, the sides of both the upper and lower housing member are broken away. The pliers include a support (21) comprising a first handle (23) having an upper housing member (25) fixedly mounted at one end of the first handle (23). A lower housing member (27) is pivotally mounted to the first housing member (25) at pivot (29). A second handle (not shown) is pivotally mounted to said second housing member and slidably mounted to said first handle in a manner commonly used in vise-grip pliers.

The upper housing member (25) is generally cup-shaped with its open side facing downwardly. The lower housing member (27) is generally cup-shaped with its open side facing upwardly opposite the open side of the upper housing member (25). An upper jaw (31) is mounted in the upper housing member (25) and a lower jaw (33) is mounted in the lower housing member (27).

The upper jaw (31) includes three upper rollers (33A), (33B) and (33C) mounted on three upper axles (35A), (35B) and (35C) respectively supported at each end thereof from its own free-floating cage (36) (FIG. 2) in a triangular arrangement. An upper continuous loop (37) of chained links is movably mounted to pass around the three upper rollers (33A), (33B) and (33C)

along a path including a first straight segment (39), which faces downward.

A dog (41) is mounted on a pin (43) which is supported at both ends in the upper housing member (25). One end (45) of the dog (41) normally engages the upper chain loop (37) at positions away from the first straight segment (39). The other end (47) of the dog (41) is attached to a flat spring (49) which is fixedly supported from the upper housing member (25) by a spring support (51). The spring-mounted dog (41) detachably engaging the upper loop (37) constitutes a ratchet means which permits the upper loop to move in only one direction around the upper rollers.

The lower jaw (33) includes three lower rollers (53A), (53B) and (53C) mounted on three lower axles (55A), (55B) and (55C) respectively supported at each end thereof from its own free-floating cage (not shown) in a triangular arrangement. A lower continuous loop (57) of chained links is movably mounted to pass around the three lower roller (53A), (53B) and (53C) along a path including a second straight segment (59), which faces upward and is opposite the first straight segment (39).

Each of the upper rollers (33A), (33B) and (33C) and the lower rollers (53A), (53B) and (53C) is freely rotatable and is preferrably mounted with ball-bearings. Each of these rollers has a low flange at each end thereof to assist in guiding each of the associated loops (39) and (59) along its prescribed path. As shown in FIG. 2, the middle rollers (33B) and (53B) have larger diameters than the side rollers in order to support the straight segments when pressure is applied to a nut or bolt.

Instead of mounting the ratchet means to engage the upper loop (37), it may be mounted to engage the lower loop (57). Or, there may be a ratchet means engaging each of the loops (37) and (57). The ratchet means may be adapted to push the loop it engages to move in either direction but, if there is a ratchet means engaging each loop, the two ratchet means must cooperate to push both of the two loops (37) and (57) to move in the same directions with respect to each other; that is, either both move clockwise or both move counter-clockwise.

Figure 3:
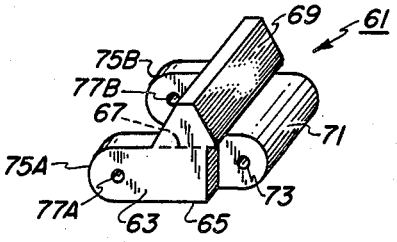
FIG. 3 is a perspective view of a chain link used in the preferred embodiment shown in FIGS. 1 and 2.

A typical link (61) used in the upper loop (37) and the lower loop (39) is shown in FIG. 3. The link (61) consists of a base (63) having rectangular cross-sections both parallel and transverse to its direction of travel. Its bottom or inner surface (65) is generally flat or concave and adapted to contact the outer surfaces of the rollers (33) and (35). The upper or outer surface (67) of the base (63) carries an integral tread (69) thereon which may be in the form of a triangular prism that is truncated at its top.

One side of the link base (63) has an integral central bar (71) that is indented at each end thereof and has a central aperture (73) there through. The other side of the link base (63) has an integral side bar (75A) and (75B) at each end thereof. Each side bar (75A) and (75B) has a side aperture (77A) and (77B) therethrough and is of such thickness as to fit into the indented portions of the central bar (71) (of an adjacent link) with a small amount of play. To form a loop of links (61), a pin (not shown) through the central aperture (73) of one link and the side apertures (77A) and (77B) of its adjacent link holds the links together. The treads (69) of the links in the straight segments (39) and (59) are adapted to fit closely against the treads of the adjacent links, and thereby constitute the jaw faces of the upper and lower jaws (31) and (51).

Figure 4:
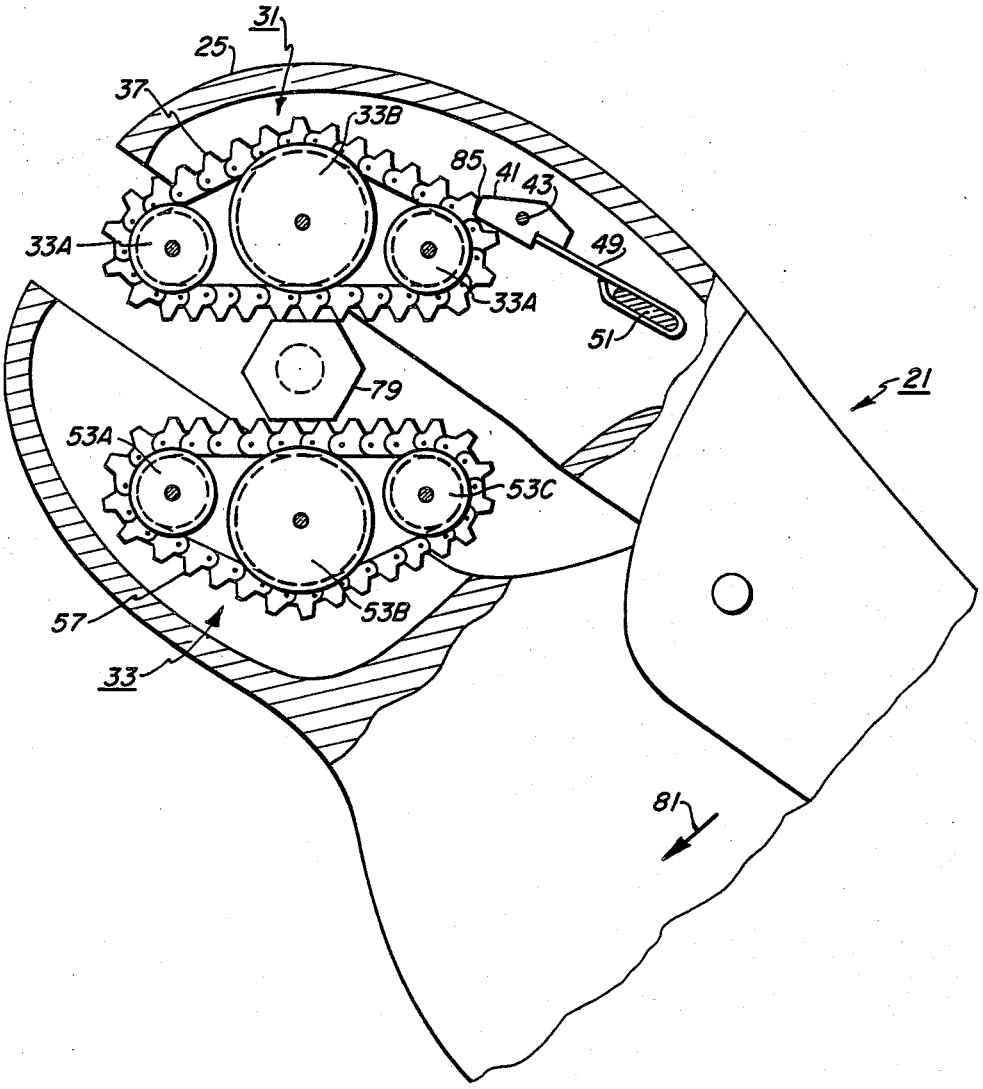
FIG. 4 is a side view of the novel tool shown in FIG. 2 just after the tool has been rotated by arcuate movement around the nut.
Figure 5:
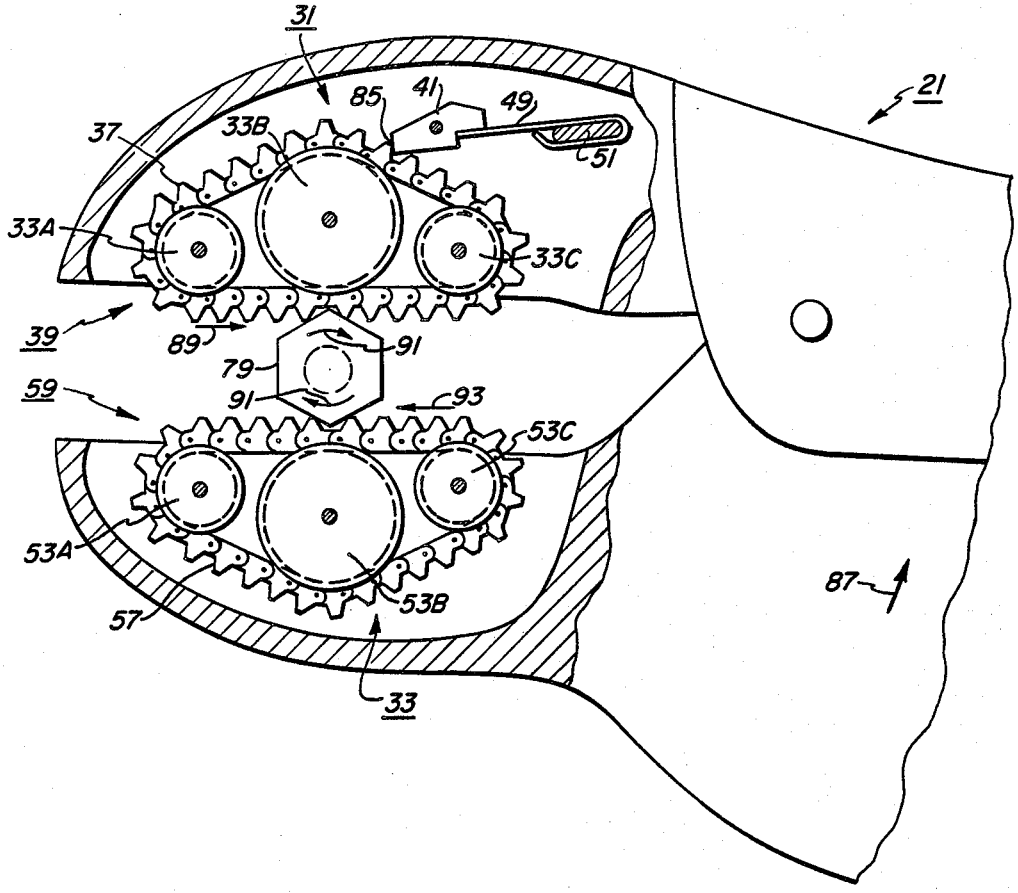
FIG. 5 is a side view of the novel tool shown in FIG. 2 while the ratchet means is engaged and both the tool and the nut are being rotated by arcuate movement.

The operator of the novel tool is illustrated in steps shown in FIGS. 2, 4 and 5. As shown in FIG. 2, the jaw faces (39) and (59) engage opposite faces of a hexagonal-head nut (79) as is normally done with a vise-grip pliers, or with any other tool with open-ended jaws.

As shown in FIG. 4, the support (21) and housing portions (25) and (27) are rotated clockwise as shown by the arrow (81) while the nut (79), the upper jaw (31) and lower jaw (33) remain stationary relative to the support (21) and housing portions (25) and (27). For this movement, the dog (41) disengages from its initial position (83) (FIG. 2) on the upper loop (37) and slides on top of the treads to a new position (85) (FIG. 4) on the upper loop (37).

As shown in FIG. 5, the support (21) and housing portions (25) and (27) are rotated counter-clockwise as shown by the arrow (87). As the support rotates, the dog (41) pushes the upper loop (37) in a counter clockwise direction as shown by the arrow (89), causing the nut (79) to rotate in the clockwise direction as shown by the arrows (91), which causes the lower loop (57) to rotate in a counter clockwise direction as shown by the arrow (93). The rotation of the support continues until it reaches the position shown in FIG. 2. Then the process is repeated.

Figure 6:
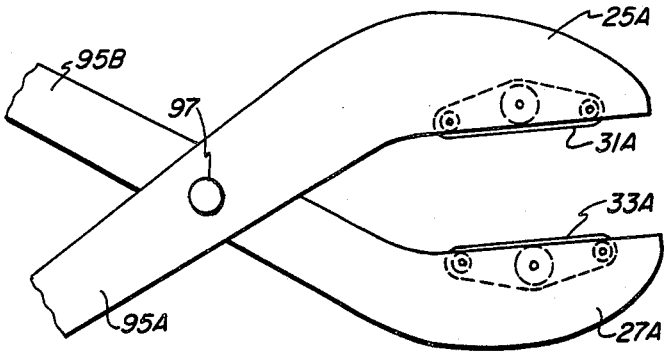
FIG. 6 is a side view of a second embodiment of the novel tool in the form of a scissors-type pliers.

The jaw (31) and (33) shown in FIGS. 1 and 2 may be incorporated into a tool in the form of a scissor-type pliers as shown in FIG. 6. The pliers includes a pair of crossed handles (95A) and (95B) held together by a pivot pin (97). The opposed jaws (31A) and (33A) are supported in upper and lower housings (25A) and (27A) as described above with respect to FIGS. 1 and 2.

Figure 7:
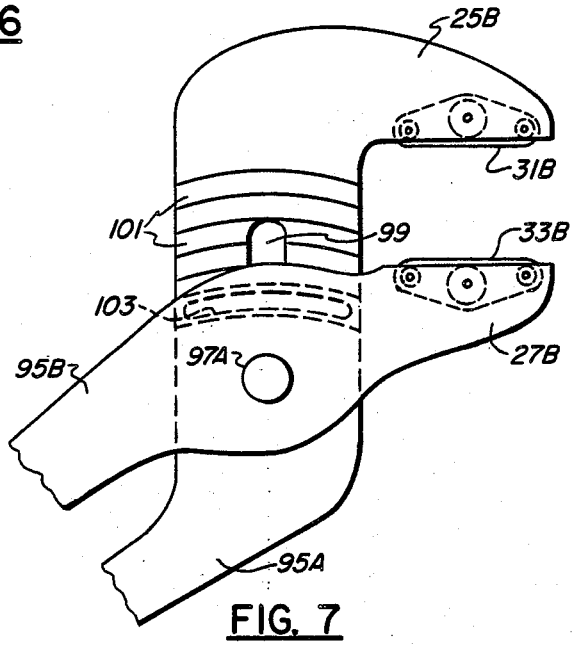
FIG. 7 is a side view of a third embodiment of the novel tool in the form of a slip-type pliers.

As shown in FIG. 7, opposed jaws (31B) and (33B) may be incorporated into a slip-type pliers also having crossed handles (95C) and (95D) held together by a pivot pin (97A), in a similar manner to that shown with respect to FIG. 6. In addition, a slip-type pliers has, in one handle, a slot (99) and several radial grooves (101), and a radial ridge (103) in the other handle adapted to slip into one of the grooves (101); thereby providing means for adjusting the spacing between the jaws (31B) and (33B), as is practiced in prior tools.

Figure 8:
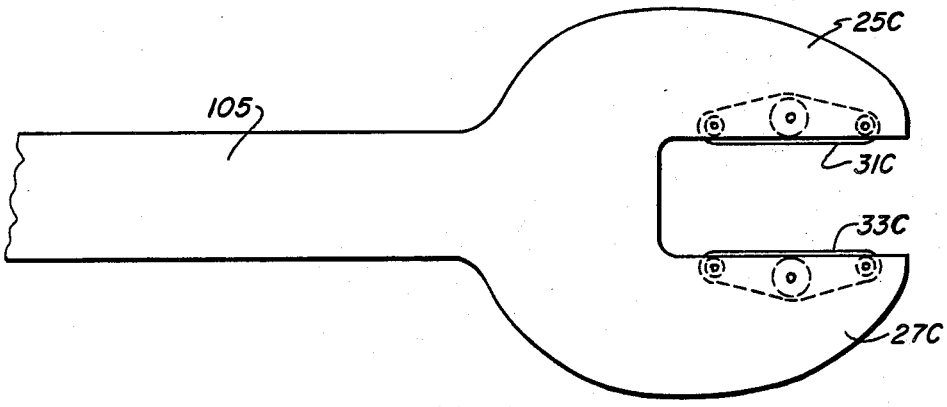
FIG. 8 is a side view of a fourth embodiment of the novel tool in the form of an open-ended wrench.

The jaws (31) and (33) shown in FIGS. 1 and 2 may be incorporated into a tool in the form of an open-ended wrench as shown in FIG. 8. The wrench includes a bar or lever (105) having integral upper and lower housings (25C) and (27C) at one end thereof. Opposed jaws (31C) and (33C) are supported in the upper and lower housing (25C) and (27C) as described above with respect to FIGS. 1 and 2. The spacing between the jaws is fixed, but may be made adjustable by mounting the lower housing with a worm gearing, as in a crescent wrench.

The mode of operation is essentially the same as described above with respect to FIGS. 2, 4 and 5. Thus, with any of the embodiments of the novel device, a nut or bolt head may be loosened or tightened by a succession of arcuate movements of the tool without removing the jaw faces from the faces of the nut or bolt. Thereby, the user can save both time and effort. In addition, the tool can be used in places where there is very limited clearance.

The foregoing figures and descriptions thereof are provided as illustrative of some of the preferred embodiments of the concepts of this invention. While these embodiments represent what is regarded as the best modes for practicing this invention they are not intended as delineating the scope of the invention, which is set forth in the following claims.

What is claimed is:

1. In a tool having a pair of open-ended jaws with spaced confronting jaw faces and a support for said jaws, the improvement wherein each jaw comprises a separate continuous loop of chained links movably mounted on a separate plurality of rotatable rollers, each said plurality of rollers being mounted in a pivotable cage which provides for angular adjustment of said continuous loops of chain link, each of said loops having a substantially straight segment that is spaced from and confronts the straight segment of the other of said loops, each link having a tread on the outer side of said loop, which tread aligns with the treads of the other links in said straight segment to constitute the confronting face of said jaw, and a ratchet means mounted on said support and adapted to push one of said loops to move in only one direction around its supporting rollers.

2. The tool defined in claim 1 wherein said ratchet means includes a spring-loaded dog detachably engaging said one loop.

3. The tool defined in claim 2 wherein said dog engages said loop at locations other than along said straight segment.

4. The tool defined in claim 1 wherein each of said treads has a rectangular base adapted to fit closely against the bases of the treads of the adjacent links in said straight segment.

5. The tool defined in claim 4 wherein each of said bases has an integral triangular prism thereon, said prism being truncated to provide a flat top thereon.

6. The tool defined in claim 1 wherein said support includes a housing to which said rollers and ratchet means are mounted.

7. The tool defined in claim 6 wherein said tool is in the form of a pliers and said support includes a pair of crossed pivoted handle members, each handle member having a housing portion mounted at one end thereof, each housing member housing one of said jaws.

8. The tool defined in claim 6 wherein said tool is in the form of a vise-grip pliers and said support includes a first handle, a first housing member fixedly mounted at one end of said first handle, said first housing member housing said one of said jaws, a second housing member pivotally mounted to said first housing member, said second housing member housing the other of said jaws and being pivotally mounted to said first housing member, and a second handle pivotally mounted to said second housing member and slidably mounted to said first handle.

9. The tool defined in claim 6 wherein said tool is in the form of an open-ended wrench in which the spacing between said jaw faces is fixed and said support includes a lever, said housing being fixedly mounted at one end of said lever.

10. The tool defined in claim 6 wherein said tool is in the form of a crescent wrench in which the spacing between said jaw faces is adjustable and said support includes a lever, said housing being fixedly mounted at one end of said lever.

* * * * *